United States Patent [19]

Kojima

[11] Patent Number: 4,982,673

[45] Date of Patent: Jan. 8, 1991

[54] BUTTON SEWING MACHINE

[75] Inventor: Toshihiko Kojima, Toyonaka, Japan

[73] Assignee: Yamato Mishin Seizo Kabushiki Kaisha, Osaka, Japan

[21] Appl. No.: 431,777

[22] Filed: Nov. 6, 1989

[30] Foreign Application Priority Data

Nov. 7, 1988 [JP] Japan ..... 63-281988
Nov. 7, 1988 [JP] Japan ..... 63-281989
Nov. 7, 1988 [JP] Japan ..... 63-281990
Nov. 7, 1988 [JP] Japan ..... 63-145692

[51] Int. Cl.[5] ..... D05B 3/14
[52] U.S. Cl. ..... 112/112; 112/121.12
[58] Field of Search ..... 112/112, 113, 109, 110, 112/121.12, 265.1, 111

[56] References Cited

U.S. PATENT DOCUMENTS 4,296,697 10/1981 Barth et al. ..... 112/109
4,854,252 8/1989 Asao et al. ..... 112/112 X

FOREIGN PATENT DOCUMENTS 3815561 12/1988 Fed. Rep. of Germany ..... 112/112

*Primary Examiner*—Peter Nerbun

[57] ABSTRACT

A button sewing machine including comprises a stitching needle supported for reciprocating movement up and down; a button holder for holding a sew-through button, which has been sewed on a piece of fabric via at least one looped thread connecting the sew-through button with the piece of fabric, so as to permit the looped thread to extend generally horizontally when the piece of fabric is folded to provide upper and lower segments thereof, one above the other; a fabric holder adapted to be inserted in between the upper and lower segments of the piece of fabric to support the piece of fabric with the upper and lower segments positioned above and below the fabric holder, respectively; a fabric retainer for pressing the upper segment of fabric from above to urge it against the fabric holder; a drive unit for driving the button holder and the fabric holder reciprocatingly and cyclically in a horizontal plane in first and second directions perpendicular to each other; a device for changing and setting the position at which a bundling operation, for turning a bundling thread around the looped thread, to form a spinned cluster of thread is initiated relative to the looped thread, in a direction generally parallel to the looped thread; and a control unit for controlling the drive unit so as to move the button holder and the fabric holder to predetermined positions thereof.

8 Claims, 13 Drawing Sheets

BUTTON SEWING MACHINE

BACKGROUND OF THE INVENTION

1. Field of the Invention

The present invention generally relates to a button sewing machine for sewing a sew-through button or mannish button on a piece of fabric such as, for example, a garment or apparel including a coat, suit, trousers and so on.

More particularly, the present invention relates to the button sewing machine having a dual function of making a looped thread between the sew-through button and the piece of fabric to attach the sew-through button to the piece fabric and then making a spinned cluster of thread (known as a wrapping neck) wound around a portion of the looped thread between the sew-through button and the piece of fabric to keep the sew-through button spaced a distance apart from the piece of fabric, and also to a button sewing machine capable of making the spinned cluster of thread around that portion of the looped thread between the sew-through button and the piece of fabric to keep the sew-through button spaced a distance apart from the piece of fabric.

2. Description of the Prior Art

As is well known to those skilled in the art, the sew-through button is known as a button of a type having at least two sew-through holes through which a needle is repeatedly pierced to pass thread therethrough to sew the button on a piece of fabric. When it comes to the fastening of the sew-through button on the piece of fabric, a looped thread is formed between the sew-through button and the piece of fabric, extending from, for example, one of the sew-through holes in the button to the piece of fabric and then through the other of the sew-through holes in the same button after having turned backwards at the opposite side of the piece of fabric and again extending from such other of the sew-through holes over a bridge portion between the two sew-through holes into such one of the sew-through holes. The looped thread so formed to sew the button on the piece of fabric generally consists of a number of turns of thread.

It is also well known to those skilled in the art that turns of thread forming the looped thread and located in a space between the sew-through button and the piece of fabric are bundled together to provide a spinned cluster of thread to keep the sew-through button in a generally floated fashion relative to the piece of fabric, that is, to keep the sew-through button spaced a distance apart from the piece of fabric, which distance corresponds generally to the thickness of the opposite piece of fabric in which a button hole is formed, so that the button on one piece of fabric can easily and smoothly be passed through the button hole in the opposite piece of fabric, it being noted that one piece of fabric and the opposite piece of fabric may be different portions of the same garment or clothing.

In order to sew the sew-through button on the piece of fabric firmly and in the generally floated fashion, it is generally necessary to perform a job (hereinafter referred to as a button sewing job) of sewing the sew-through button on the piece of fabric to form the looped thread therebetween and a job (hereinafter referred to as a bundling job) of forming the spinned cluster of thread around the turns of thread forming the looped thread. The thread forming the looped thread during the performance of the button sewing job and the thread forming the spinned cluster of thread during the performance of the bundling job may be continuous or separate from each other.

Although the bundling job to form the spinned cluster of thread for bundling the turns of thread between the sew-through button and the piece of fabric together may not be always essential, the performance of the bundling job, that is, the formation of the spinned cluster of thread, subsequent to the button sewing job is effective not only to permit the sew-through button to be firmly secured to the piece of fabric, but also to permit the sew-through button to be kept in the generally floated fashion relative to the piece of fabric. To keep the sew-through button secured to the piece of fabric, in the generally floated fashion relative to the piece of fabric, is particularly advantageous in that the button so sewed on the piece of fabric can be easily and smoothly engaged through the button hole defined in the opposite piece of fabric.

According to the prior art, the button sewing job and the bundling job are performed either by the use of separate sewing machines each exclusively designed for the respective job, or by the use of a single sewing machine which, although designed for the button sewing operation, requires an accessory or attachment, specially designed for the bundling operation, to be fitted to a needle plate or slide plate of the sewing machine.

Where the two sewing machines are employed for the button sewing and bundling operations, respectively, not only does an apparel manufacturer tend to be constrained by reason of economy since these two sewing machines employ a number of similar component parts, but the apparel manufacturer is also required to prepare a relatively large space for installation of the sewing machines. Moreover, the use of the separate sewing machines for the streamlined accomplishment of the button sewing and bundling jobs requires attendant workers to perform separate placement jobs for the setting of the piece of fabric on the respective sewing machine in readiness for the job to be performed. This renders the work efficiency lowered.

In the environment in which the single sewing machine which requires the use of the specially designed accessory or attachment as hereinabove described is employed, an attendant worker is required to undergo a sequence of removing the piece of fabric, on which the sew-through button has been sewed, from the sewing machine, then setting the specially designed attachment on the sewing machine and placing the once-removed piece of fabric again on the sewing machine in readiness for the bundling operation. Accordingly, as compared with the environment in which the two sewing machines are employed, the use of the single sewing machine constitutes a cause of a considerable reduction in work efficiency.

As far as the button sewing operation hitherto performed in the art is concerned, where the position from which the bundling operation is started relative to the piece of fabric is to be changed in a direction along the lengthwise direction of the thread, a mechanical method is employed in which a plurality of different types of cam members must be provided so that the start position at which the bundling operation is initiated can be changed by the replacement of one of the cam members with a different one of the cam members.

If the number of stitches to be performed to secure the sew-through button on the piece of fabric is properly chosen depending on the length, diameter and/or material of sewing thread, a high quality button fitting in which the sew-through button is sewed firmly on the piece of fabric in the generally floated fashion can be accomplished in a manner similar to that accomplished by hand. However, with the prior art button sewing machine, even a mechanical method is employed for the selection of the number of stitches to be performed, in such a way as to replace one cam member with another cam member.

The above described prior art methods require a complicated and time-consuming replacement job to change the type of cam member through a partial dismantling of the sewing machine each time the starting position at which the bundling operation is initiated and/or the number of stitches for the bundling operation are altered, thereby compounding a reduction in work efficiency.

An example of the prior art button sewing machine designed to perform the bundling operation is fragmentarily shown in FIGS. 1*a* and 1*b* of the accompanying drawings.

Referring to FIGS. 1*a* and 1*b*, reference numeral 1 represents a stitching needle supported for movement in a direction up and down perpendicular to a fabric guide bench 2 in a manner well known to those skilled in the art. Reference numerals 3 and 4 represent respective guide plates mounted on a feed plate 5, the spacing l1 between said guide plates 3 and 4 being adjustable. The feed late 5 is mounted on the fabric guide bench 2 and is adapted to be driven by a suitable drive mechanism (not shown) so as to move in sliding contact with the fabric guide bench 2 reciprocatingly and cyclically in a direction shown by the arrow-headed line a–b and also in a direction shown by the arrow-heated line c–d. A sew-through button 6 having two pairs of sew-through holes is shown as already fastened to, that is, sewed on, a piece of fabric 8 through respective looped threads 7.

The guide plates 3 and 4 have respective cut grooves 3A and 4A defined therein so as to extend downwardly and inwardly from an upper edge thereof for receiving therein the looped threads 7 with the guide plates 3 and 4 held in contact with the piece of fabric 8 and the sew-through button 6, respectively, to keep the piece of fabric 8 and the sew-through button 6 spaced apart from each other while the looped threads 7 can extend generally horizontally, that is, in a direction generally parallel to the fabric guide bench 2 in readiness for the bundling operation to be subsequently performed. It is to be noted that the piece of fabric 8 is shown as folded to allow the fastened sew-through button 6 to protrude with the looped threads 7 extending in a direction generally parallel to the fabric guide bench 2. Thus, the guide plates 3 and 4 cooperate with each other as a combined button holder and spacer.

After the looped threads 7 fastening the sew-through button 6 to the piece of fabric 8 has been set in a predetermined bundling position as described above with reference to FIGS. 1*a* and 1*b*, the sewing machine is electrically powered to drive the stitching needle reciprocatingly up and down and, at the same time, to drive the feed plate 5 reciprocatingly and cyclically in the directions a–b and c–d so that, as shown by points A to N in FIG. 2, the feed plate 5 can be stepwise moved for each stitch to turn a bundling thread 9 around the looped threads 7 to form a spinned cluster of thread to bundle the turns of thread of the looped threads 7 together.

According to the prior art, at the start of the bundling operation performed in the manner as hereinabove described, the first stitch is initiated from a point shown by 0 in FIG. 2 which is located adjacent the root of the looped thread 7, that is, adjacent the piece of fabric 8.

Referring again to FIGS. 1*a* and 1*b*. and in the prior art sewing machine shown therein, the presence of the guide plate 4 tends to restrict the first stitch of bundling operation to be initiated from the point 0 as shown in FIG. 2, that is, adjacent the root of the looped thread 7. Because of this, an end portion of the bundling thread 9 corresponding to the first stitch cannot be firmly retained in position and is apt to be loosened and, therefore, even though that end portion of the bundling thread 9 has once been wound around the looped thread 7, that end portion of the bundling thread 9 is loosened to displace out of the way as the stitching needle is moved upwards. Once this occurs, a looper in the sewing machine tends to fail to catch the bundling thread 9 during the bundling operation and, as a result, a further bundling operation subsequent to the first stitch will no longer be performed and, if not impossible, the bundling thread 9 once turned around the looped thread tends to be loosened.

Another example of the prior art sewing machine capable of performing the bundling operation is fragmentarily shown in FIG. 3. Referring now to FIG. 3, reference numeral represents a stitching needle supported for movement reciprocatingly up and down along a line shown by the phantom line in a direction substantially perpendicular to a needle plate 13. The needle plate 13 is, as best shown in FIG. 4, provided with a protruding land 13*b* having defined therein a generally elongated slot 13*a* for the passage of the stitching needle 1 therethrough during the up and down movement thereof. Reference numeral 14 represents a button holder for elastically releasably holding a sew-through button 6 in engagement with opposite peripheral edge portions of the sew-through button 6 from opposite sides. Reference numeral 19 represents a fabric holder for supporting a piece of fabric 8, on which the sew-through button 6 has already been sewed through the looped thread 7, in such a manner that the piece of fabric 8 is folded therearound with the looped thread 7 extending generally horizontally, that is, in a direction generally perpendicular to the direction of movement of the stitching needle 1. It is to be noted that the piece of fabric 8 retained on the fabric holder 19 is fixedly positioned on the needle plate 13 and the fabric guide bench (not shown in FIG. 3). With the piece of fabric 8 and the sew-through button 6 supported fixedly by the fabric holder 19 and the button holder 14, respectively, the looped thread 7 can extend generally horizontally, that is, in a direction generally perpendicular to the direction of movement of the stitching needle 1, while traversing over the slot 13*a* in the needle plate 13.

When it comes to the bundling operation performed by the prior art sewing machine of the construction shown in FIGS. 3 and 4, where the minimum distance between the piece of fabric 8 on the fabric holder 19 and the sew-through button 6, that is, the width over which the spinned cluster of thread is to be formed as a result of the bundling operation, is relatively great, the bundling thread 9 can be turned around the looped thread 7 while substantially uniformly distributed over the width l when the button holder 14 and the fabric holder 19 are reciprocatingly and cyclically driven in a horizontal plane in two respective directions perpendicular to each other.

However, where the width is relatively small, the range over which the movement in one of the directions, that is, frontwardly and rearwardly, is effected is required to be reduced considerably or the movement in the other of the directions, that is, leftwards and rightwards, must be disabled, so that the bundling thread can be turned several times at the same position so as to form a generally radially outwardly bulged cluster of thread around the looped thread. In such case, since the resultant spinned cluster 9a of thread wound around the looped thread 7 represents a generally radially outwardly bulged shape at a portion of the looped thread intermediate between the sew-through button 6 and the piece of fabric 8, the sew-through button can be fastened to the piece of fabric in an aesthetically unpleasant manner but also a relatively increased number of stitches is required. Moreover, the sew-through button cannot be firmly fastened to the piece of fabric even with the increased number of stitches.

SUMMARY OF THE INVENTION

Therefore, a primary object of the present invention is to provide an improved button sewing machine having automatically successively performed dual functions of making a looped thread between the sew-through button and the piece of fabric to secure the sew-through button to the piece of fabric and then making a spinned cluster of thread wound around a portion of the looped thread between the sew-through button and the piece of fabric to keep the sew-through button spaced a distance apart from the piece of fabric, which machine can contribute to an increase in work efficiency.

Another important object of the present invention is to provide an improved button sewing machine of the type referred to above, wherein a change in starting position at which the bundling is initiated and also in number of stitches to be performed, which may be required depending on the thickness of the piece of fabric and the length, diameter and/or material of the bundling thread, can be accomplished easily and quickly, thereby to achieve the high quality button fastening operation at high work efficiency.

A further important object of the present invention is to provide an improved sewing machine capable of making the spinned cluster of thread around that portion of the looped thread between the sew-through button and the piece of fabric to keep the sew-through button spaced a distance apart from the piece of fabric, with one end portion of the bundling thread being assuredly and firmly retained in position.

A still further important object of the present invention is to provide an improved sewing machine of the type referred to above, wherein, even though the width over which the bundling thread is turned around the looped thread to form the spinned cluster of thread is relatively small, the bundling thread can be substantially uniformly distributed over the length of the looped thread between the sew-through button and the piece of fabric thereby to firmly fasten the sew-through button on the piece of fabric.

To this end, the button sewing machine according to one aspect of the present invention comprises a stitching needle supported for reciprocating movement up and down; a needle plate having defined therein an opening through which the stitching needle moves during the reciprocating movement thereof; a button holder means for holding a sew-through button to be sewed on a piece of fabric; a fabric holding means for supporting the piece of fabric while the piece of fabric is folded to provide upper and lower segments of fabric which are positioned above and below the fabric holding means, respectively; a fabric retainer means for pressing the upper segment of fabric from above to urge it against the fabric holding means; a drive means for driving the button holder means and the fabric holding means reciprocatingly and cyclically in a horizontal plane in first and second directions perpendicular to each other; a button holder position switching means for changing the button holder selectively to assume one of a button sewing position, in which the sew-through button can be sewed on the piece of fabric by means of a looped thread extending between the sew-through button and the piece of fabric, and a bundling position in which the looped thread fastening the sew-through button to the piece of fabric can extend generally horizontal while traversing over the opening defined in the needle plate; an operating status changing means for switching the drive means selectively to assume one of a first status, in which the button holder means and the fabric holding means can be reciprocatingly driven in one of the directions perpendicular to each other, and a second status in which the button holder means and the fabric holding means can be simultaneously driven reciprocatingly in the directions perpendicular to each other; and a control means for detecting a completion of a button sewing job and operable in response to the detection of the completion of the button sewing job to cause the button holder position switching means to assume the bundling position and also to cause the drive means to assume the second status.

Preferably, the button sewing machine may further comprise a speed changing means operable during any one of button sewing and bundling operations to change a stitching speed assumed at the time of start of a stitching operation to a value lower than a stitching speed assumed during a normal stitching operation.

With the button sewing machine so constructed as hereinabove described, when the sew-through button is mounted on the button holder means then held in the button sewing position and the piece of fabric folded to provide that the upper and lower segments is mounted over the fabric holding means with the upper and lower segments positioned above and below the fabric holding means, and when the fabric retaining means is subsequently lowered to press the upper segment of the folded piece of fabric from above, the sew-through button and the piece of fabric on which the sew-through button is to be sewed can be set on the sewing machine in a manner substantially free from wrinkles occurring in the piece of fabric.

When the sewing machine is then electrically powered after the sew-through button and the piece of fabric have been set thereon in the manner as hereinabove described, the stitching needle starts its reciprocating up and down movement and, with the drive means held in the first status, the button holder means and the fabric holding means are reciprocatingly driven in one of the first and second directions perpendicular to each other with the stitching needle repeatedly passed through the sew-through holes in the button to form the looped thread to fasten the sew-through button to the piece of fabric.

After a predetermined number of times over which the stitching is performed to form the looped thread, the button holder position switching means is automatically operated in response to a completion signal indicative of the completion of the stitching over the predetermined number of times, causing the button holder means to be brought into the bundling position in which the looped thread connecting the sew-through button with the piece of fabric extends generally horizontal and generally parallel to the needle plate while traversing over the opening defined in the needle plate and, at the same time, the drive means is automatically switched over onto the second status.

After the above described condition has been established and when the sewing machine is again electrically powered to cause the stitching needle to undergo the reciprocating up and down movement relative to the needle plate, the button holder means and the fabric holding means can be reciprocatingly driven in synchronism with each other in the first and second directions perpendicular to each other so that the piece of fabric having the sew-through button sewed thereon can be moved stepwise for each stitch in a direction substantially parallel to the direction in which the looped thread extends, thereby to perform the bundling operation to bundle turns of thread forming the looped thread together.

According to a preferred embodiment of the present invention, during any one of the button sewing and bundling operations the stitching speed at the start of stitching is chosen to be of a value lower than that during the normal stitching operation. Accordingly, even with the piece of fabric which is relatively slippery or which is coarse or meshed, any possible fall of the button sewing thread, which would eventually form the looped thread, or the bundling thread off from the piece of fabric under the influence of an inertia force can be advantageously avoided to ensure a firm retention of one end portion of the button sewing or bundling thread.

Also, when the sew-through button is mounted on the button holder means and then held in the button sewing position, and the piece of fabric folded to provide the upper and lower segments mounted over the fabric holding means with the upper and lower segments positioned above and below the fabric holding means, and when the fabric retaining means is subsequently lowered to press the upper segment of the folded piece of fabric from above, the sew-through button and the piece of fabric on which the sew-through button has been sewed can be set in position with the looped thread extending generally horizontal while traversing over the opening defined in the needle plate and also with the piece of fabric set on the sewing machine in a manner substantially free from wrinkles occurring in the piece of fabric.

The subsequent electrical powering of the sewing machine results in the start of the stitching needle movement reciprocating up and down relative to the needle plate and can, at the same time, result in the button holder means and the fabric holding means to be reciprocatingly driven in synchronism with each other in the first and second directions perpendicular to each other so that the piece of fabric having the sew-through button sewed thereon can be moved stepwise for each stitch in a direction substantially parallel to the direction in which the looped thread extends, thereby to perform the bundling operation to bundle turns of thread forming the looped thread together.

According to another feature of the present invention, if prior to the initiation of the bundling operation, the start position from which the bundling operation is initiated is changed in a direction along the length of the looped thread depending on the thickness and/or material of the piece of fabric, the start position can be defined either close to or away from the piece of fabric thereby to avoid any possible formation of wrinkles in the piece of fabric during the bundling operation and to finish the fastening of the sew-through button to the piece of fabric in the generally floated fashion.

Also, the number of times over which the stitching is carried out during the bundling operation can be chosen appropriately at the will cf a machine operator and, during the bundling operation, the bundling thread can be distributed uniformly over the length of turns of thread of the looped thread in two equal passes, each calculated as corresponding to half the number of times of stitching. Therefore, a spinned cluster of thread aesthetically pleasant in appearance can be obtained on the looped thread used to connect the sew-through button with the piece of fabric.

If prior to the start of the bundling operation in the same method as hereinabove described, and depending on the thickness and/or type of material of the piece of fabric, the position of a free end of the fabric holding means is adjusted by a first bundling stitch position adjusting mechanism in a direction close to or away from a plane in which the stitching needle is moved, the position at which the first stitch is formed can be defined at a bent portion between the upper and lower segments of the folded piece of fabric where a sufficient resistance can be applied to the bundling thread to avoid any possible separation of that end portion of the bundling thread, allowing that end portion of the bundling thread to be firmly and assuredly retained in position at the start of the bundling operation.

Also, since during the bundling operation the stitching speed at the start of stitching can be automatically set to a value lower than that during the normal stitching operation, even with the piece of fabric which is relatively slippery or which is coarse or meshed, any possible fall of the bundling thread, which would eventually form the spinned cluster of thread, off from the piece of fabric under the influence of an inertia force can be advantageously avoided to ensure a firm retention of one end portion of the bundling thread.

Yet, when the sewing machine is electrically powered afterward, in the same manner as hereinbefore described, the sew-through button and the piece of fabric are set in the predetermined bundling position, not only can the stitching needle be driven reciprocatingly up and down, but also the button holder means and the fabric holding means can be reciprocated in the horizontal plane cyclically in the two directions perpendicular to each other, in synchronism with each other, to perform the bundling operation with the bundling thread while stepwisely moved for each stitch where the width over which the bundling thread is distributed along the looped thread is relatively large. In the alternative, the button holder means and the fabric holding means can be reciprocated only in one of the directions perpendicular to the lengthwise direction of the looped thread to turn the bundling thread through a predetermined number of turns around the looped thread at the same position where the width over which the bundling thread is distributed along the looped thread is relatively small. In such case, since an upper end portion of the slot-shaped opening defined in the needle plate is so formed as to have a relatively large width, the first stitch of the bundling thread turned at the same position can be urged laterally by the subsequently formed stitch of the bundling thread, whereby turns of the bundling thread formed at the same position on the looped thread can be successively displaced in a direction generally parallel to the lengthwise direction of the looped thread to form the spinned cluster of thread spread uniformly over the looped thread between the sew-through button and the piece of fabric as is the case wherein the button holder means and the fabric holding means are reciprocated in the horizontal plane cyclically in the two directions perpendicular to each other.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not be taken as limiting the scope of the present invention in any way whatsoever, which scope is to be determined solely by the appended claims. In the accompanying drawings, like reference numerals are used to denote like parts throughout the several views, and:

DETAILED DESCRIPTION OF THE EMBODIMENTS

One preferred embodiment of the present invention will now be described with reference to the accompanying drawings.

Figure 1A:
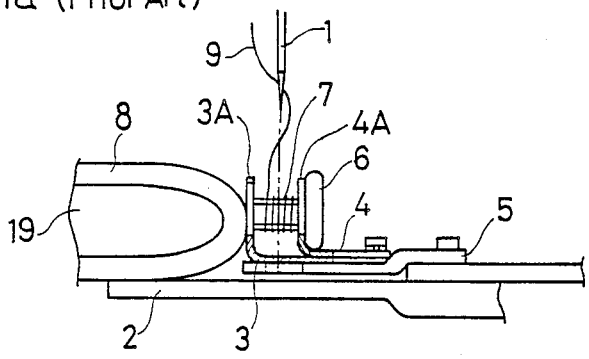
Fig.1a (Prior Art)
FIGS. 1*a* and 1*b* are schematic side and front elevational views, respectively, showing an essential portion of a prior art button sewing machine.
Figure 1B:
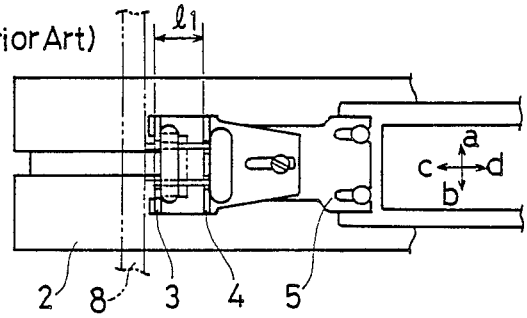
Fig.1b (Prior Art)
Figure 2:
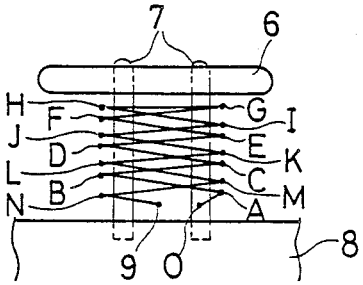
Fig.2 (Prior Art)
FIG. 2 is a schematic diagram showing the manner in which a sew-through button is sewed on a piece of fabric with the use of the button sewing machine of FIG. 1.
Figure 3:
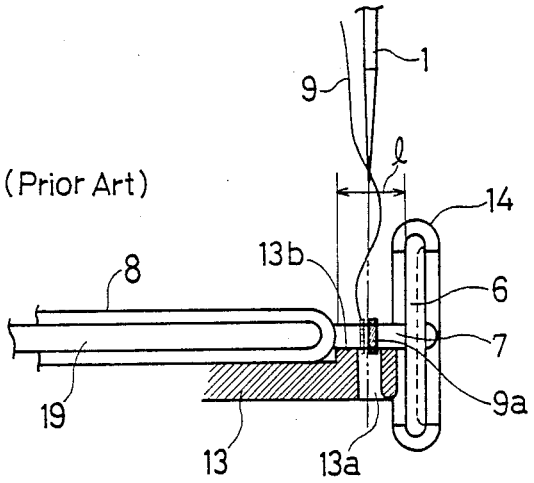
Fig.3 (Prior Art)
FIG. 3 is a schematic side sectional view showing a portion of an additional prior art button sewing machine.
Figure 4:
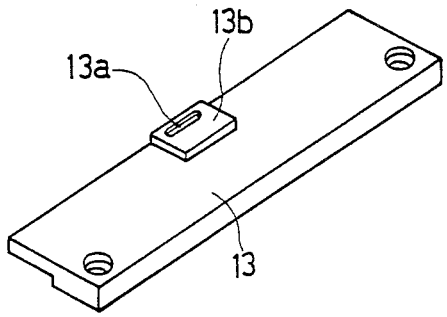
Fig.4 (Prior Art)
FIG. 4 is a perspective view, on an enlarged scale, showing a needle plate used in the sewing machine of FIG. 3.
Figure 5:
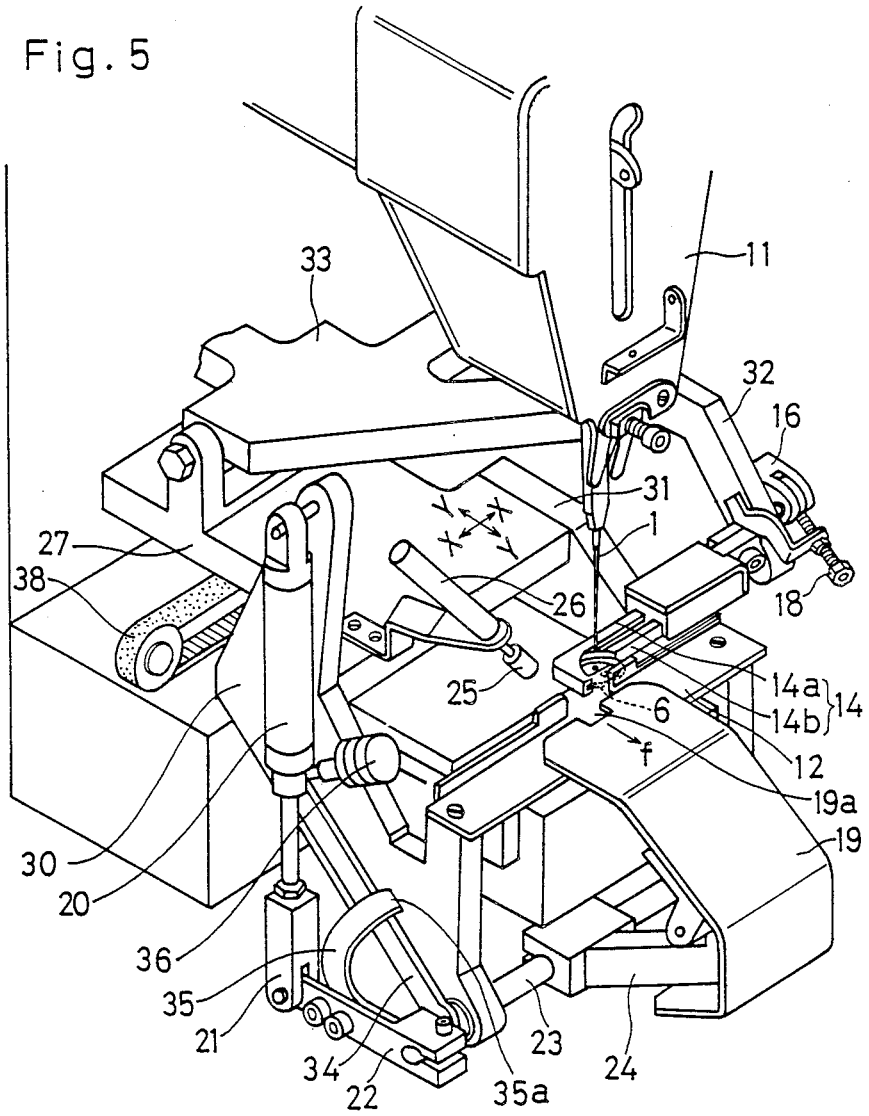
FIGS. 5 and 6 are fragmentary perspective views, as viewed from different angles, showing an important portion of a button sewing machine according to one preferred embodiment of the present invention.
Figure 6:
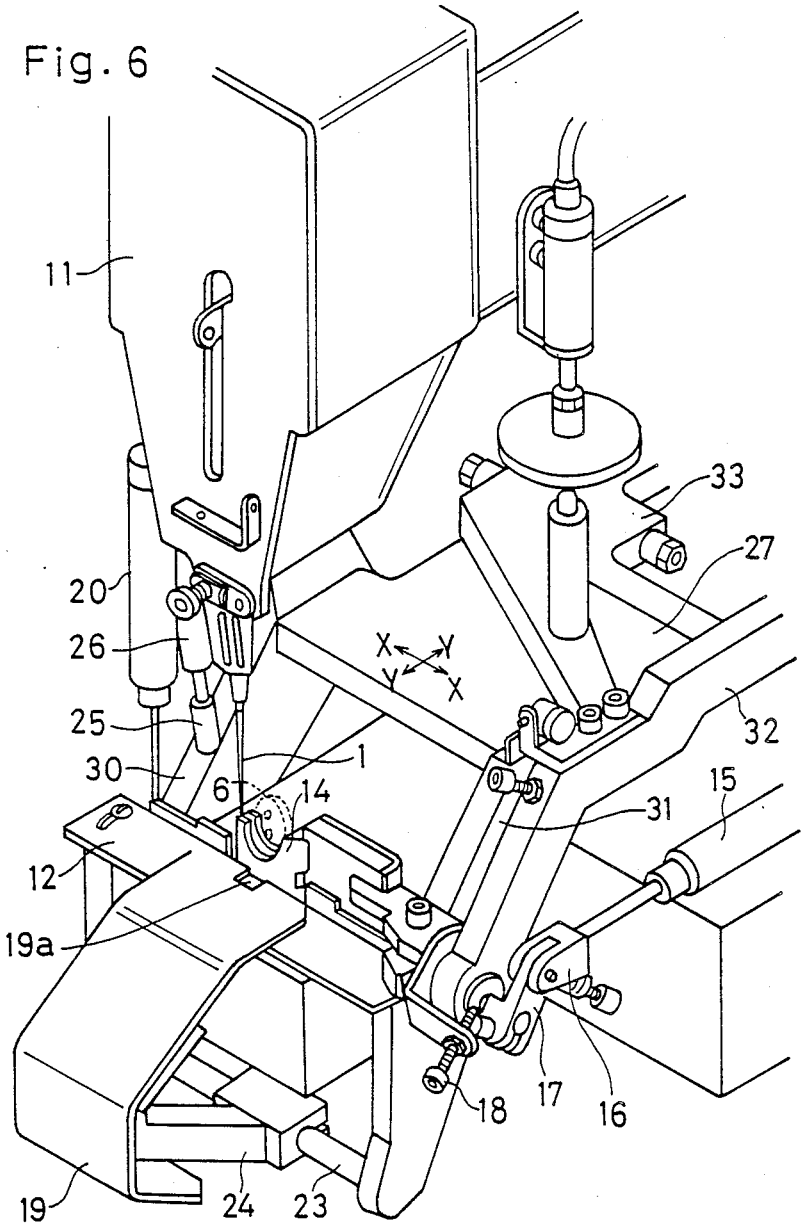

FIGS. 5 and 6 illustrate, in perspective representation, an essential portion of a button sewing machine embodying the present invention. In these figures, reference numeral 1 represents a stitching needle drivingly coupled with a reciprocating drive mechanism (not shown) housed within a machine arm 11 for reciprocating motion in a direction up and down at a predetermined position. reference numeral 12 represents a fabric guide having an undersurface to which a needle plate 13 (See FIG. 7), having a through-hole 13*a* defined therein for the passage of the stitching needle 1 therethrough during the reciprocating motion of such stitching needle 11, fixedly secured in tight contact therewith. Reference numeral 14 represents a button holder comprising a pair of generally arcuate or semicircular holder pieces 14*a* and 14*b* designed to elastically clamp a peripheral edge of a sew-through button 6 (See FIG. 13) from opposite sides in a direction radially of the sew-through button 3.

The button holder 14 is operatively coupled through connecting levers 16 and 17 with a drive cylinder 15 capable of selectively assuming one of extended and retracted positions in a direction lengthwise thereof. Accordingly, the button holder 14 can be rotated selectively to one of a button sewing position, wherein as shown in FIG. 5 the sew-through button 6 can be sewed on a piece of fabric with looped threads 7 formed therebetween, and a bundling position wherein as shown in FIG. 6, a spinned cluster of thread bundling turn of thread, of the looped threads, together can be formed around the looped threads 7. Specifically, the button holder 14 can be rotated to the button sewing position when the drive cylinder 15 is in the extended position, and to the bundling position when the drive cylinder 15 is in the retracted position.

Reference numeral 18 represents an adjustment screw used for the initial adjustment of the button sewing and bundling positions for the button holder 14.

Reference numeral 19 represents a generally plate-like fabric holder adapted to be relatively inserted in between upper and lower segments of the piece of fabric 8 so folded as to provide such upper and lower segments. In other words, the folded piece of fabric 8 can be supported and set in position on the fabric holder 19 with the upper and lower segments thereof positioned above and below the fabric holder 19. This fabric holder 19 is operatively coupled with a drive cylinder 20 through a bracket 24, then through a shaft 23 and finally through connecting levers 21 and 22, said drive cylinder 20 being capable of selectively assuming one of extended and retracted positions. Thus, the fabric holder 19 can be rotated selectively to one of a fabric retaining position, in which the piece of fabric 8 is fixedly mounted on the fabric holder 19, and a fabric releasing position in which the piece of fabric 8 can be released from the fabric holder 19, in response to the movement of the drive cylinder between the extended and retracted positions.

Figure 7:
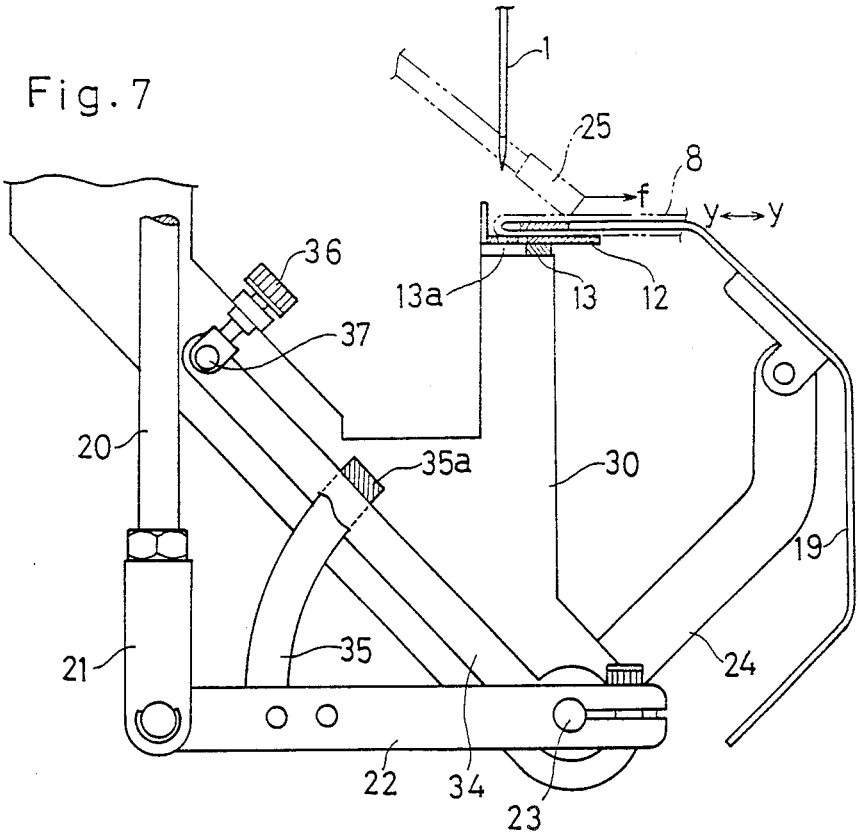
FIG. 7 is a side view, on an enlarged scale, of a portion of the button sewing machine shown in FIGS. 5 and 6.

Reference numeral represents a fabric retainer 25 adapted to be driven by a retainer operating cylinder 26 so as to contact the upper segment of the piece of fabric 8 on the fabric holder 19 from a direction generally diagonally upwardly thereby to urge the upper segment of the piece of fabric 8 in a frontward direction, shown by the arrow f as shown in FIG. 7, away from the needle plate 13 so as to avoid any possible formation of wrinkles on the upper segment of the piece of fabric 8.

Reference numeral 27 represents a movable table capable of being reciprocatingly moved in a horizontal plane synchronously in two directions perpendicular to each other, that is, in X-axis and y-axis directions. For this purpose, this movable table 27 is drivingly coupled with two stepper motors 28 and 29, as will be described with reference to FIG. 12, through respective timing belts 38 and 39.

Reference numerals 30 and 31 represents left-hand and right-hand fabric holder arms rigidly secured to left-hand and right-hand side faces of the movable table 27. The fabric guide 12 referred to hereinbefore has its opposite ends rigidly connected to the left-hand and right-hand fabric holder arms 30 and 31, with the previously described shaft 23 rotatably extending through the left-hand fabric holder arm 30. Reference numeral 32 represents a button holder arm supported by the movable table 27 through an arm coupling 33.

In the above described construction, both of the button holder 14 and the fabric holder 19 can be reciprocatingly moved in the X-axis and y-axis directions perpendicular to each other synchronously by means of the movable table 27.

Reference numeral 34 represents a fabric holder adjustment plate arranged laterally outwards along the fabric holder arm 30 and having a lower end rotatably mounted on the shaft 23. Reference numeral 35 represents an arm stopper rigidly secured at a lower end thereof to the connecting lever 22 and having a bent piece 35*a* engageable with an upper edge of an intermediate portion of the fabric holder adjustment plate 34. Reference numeral 36 represents a stopper adjusting member mounted on the fabric holder arm 30 having a free end pivotally coupled with an upper end of the fabric holder adjustment plate 34 through a pivot shaft 37.

Figure 8:
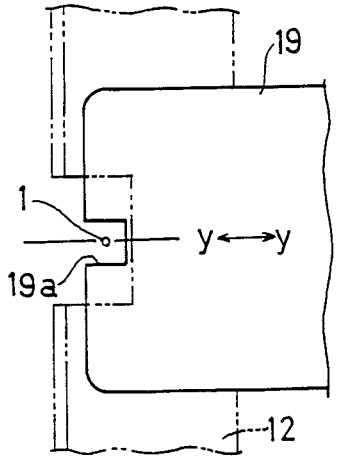
FIG. 8 is a fragmentary top plan view of the sewing machine part of FIG. 7, illustrating how a first stitch position is adjusted.

The foregoing structure is so designed as to provide a first stitch position adjusting mechanism for adjusting the position at which the first stitch is formed for the bundling operation. More specifically, the adjustment of the first stitch position can be accomplished by rotating the stopper adjusting member 36 while the drive cylinder 20 for driving the fabric holder 19 is in the extended position so that the position of a cutout 19*a* defined in a front edge of the fabric holder 19, as shown in FIG. 8 relative to the plane in which the sewing needle 1 can be reciprocatingly driven, can be displaced in a direction y—y parallel to the Y-axis direction.

Figure 9:
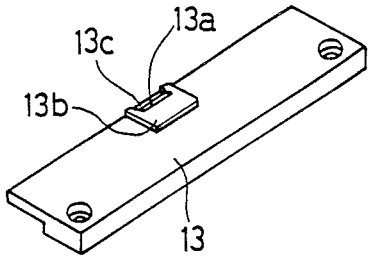
FIGS. 9 and 10 are perspective and rear side views, respectively, showing a needle plate used in the button sewing machine according to the preferred embodiment of the present invention.
Figure 10:
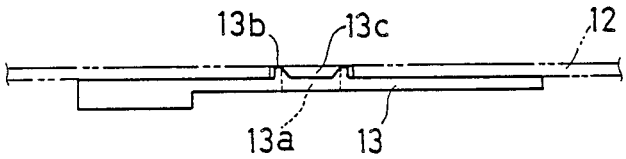
Figure 11:
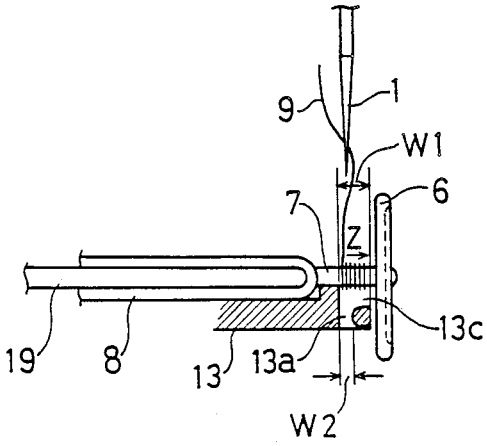
FIG. 11 is a longitudinal sectional view, on an enlarged scale, of a portion of the button sewing machine shown in FIGS. 5 and 6.

FIGS. 9 and 10 illustrate the details of the needle plate 13 in perspective and rear views, respectively. The needle plate 13 has an upwardly protruding land 13*b* defined therein, said upwardly protruding land 13*b* having a slot-shaped through-hole 13*a* defined therein for the passage of the sewing needle 1 during the reciprocating motion of such sewing needle 1. The upwardly protruding land 13*b* has a cutout 13*c* defined therein at a location along a rear peripheral edge of the through-hole 13*a* so as to extend downwards. By this construction, the width W1 of an upper portion of the through-hole 13*a* as measured in a direction along the lengthwise direction of the looped threads 7 can be made greater than the width W2 of a lower portion of the through-hole 13*a* immediately therebelow as shown in FIG. 11.

Figure 12:
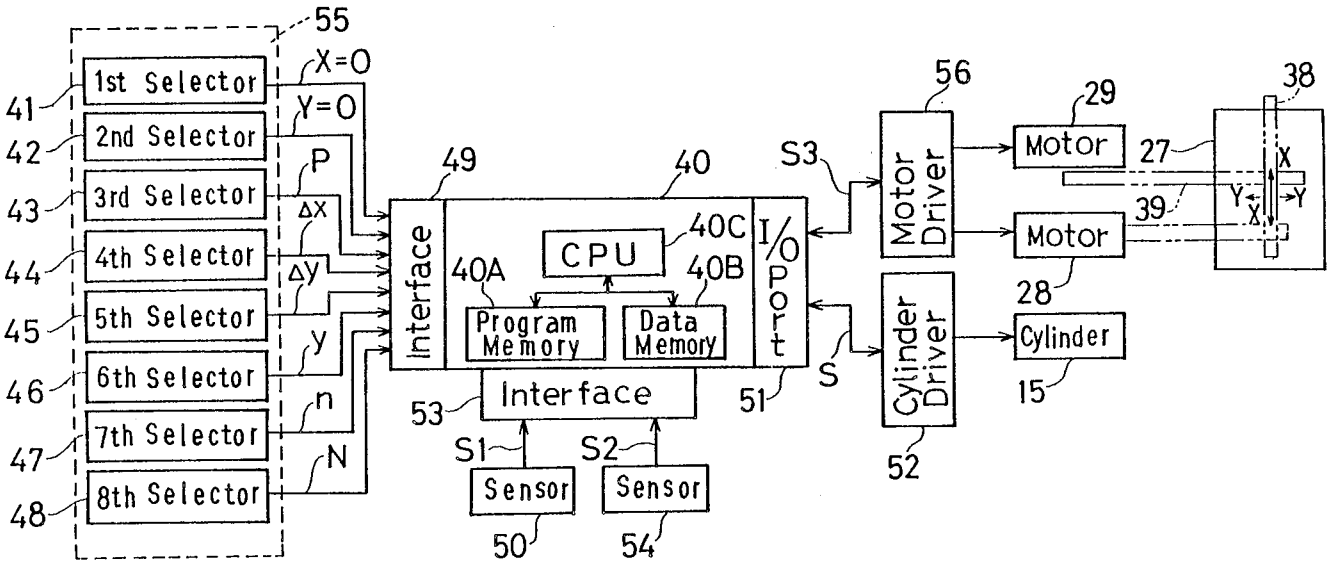
FIG. 12 is a block circuit diagram showing a control system employed in the button sewing machine according to the present invention.

FIG. 12 illustrates a block circuit diagram of a control system employed in the button sewing machine of the construction described hereinbefore. Referring now to FIG. 12, the control system comprises a microcomputer unit 40 including a programmable memory 40A for storing the sequence of a series of operations including the button sewing and bundling operations and various sewing speeds, a data memory 40B which may be a random access memory for storing various data, and a central processing unit (CPU) 40C. First to eighth selectors 41 to 48, which are disposed on a control panel 55, are electrically connected with the microcomputer unit 40 through an interface circuit 49.

The first selector 41 is used for the fine adjustment of the position of origin (X=0) in the X-axis direction and the second selector 42 is used for the fine adjustment of the position of origin (y=0) in the Y-axis direction. With these first and second selectors 41 and 42, the position of origin of the movable table 27 can be adjusted to cope with the selected type of a sew-through button 16, and the pitch between each neighboring sew-through holes in the button 16.

Figure 13A:
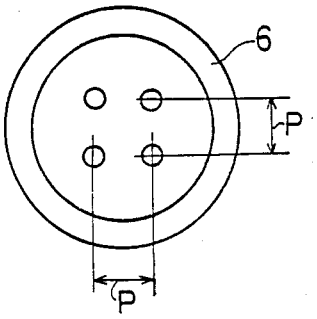
FIGS. 13*a* and 13*b* are top plan and side views of the sew-through button, respectively, which are used to illustrate the setting of an amount of movement of a table.
Figure 13B:
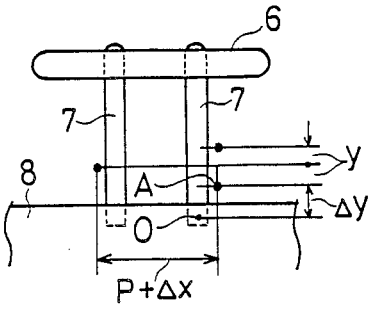
Figure 14:
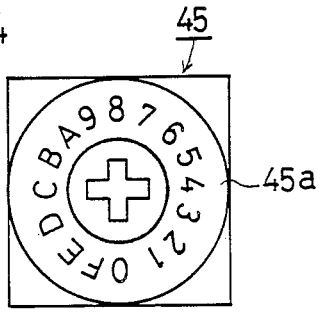
FIG. 14 is a front elevational view showing an example of a selector for changing the start position at which a bundling operation is initiated.

The third selector 43 is used for setting the hole pitch P between each neighboring sew-through holes in the sew-through button 6 as shown in FIGS. 13*a* and 13*b*, and the fourth selector 44 is used to set the unitary amount($P+\Delta x$) of movement of the movable table 27 in the X-axis direction during the button sewing operation. Since the hole pitch P can be set by the third selector 43, the fourth selector 44 is in actuality used to set the value $\Delta x$. The fifth selector 45 is used to change and set the position from which the bundling operation is started in a direction lengthwise of the bundling thread 9 relative to the piece of fabric 8 and comprises, for example, a dial knob 45*a* having 6 equally spaced calibrations "0", "1", . . . "8"and "9" and "A", "B", "C", "D", "E"and "F" embossed or otherwise imprinted thereon as shown in FIG. 14. If the dial knob 14 is rotated clockwise, as viewed in FIG. 14, from a standard position which is aligned with the calibration "8", the amount ($\Delta y$) of movement of the movable table 27 in the Y-axis direction from the first stitch position 0 to the second stitch position A relative to the piece of fabric 8, as shown in FIG. 13*b*, can be determined so that the bundling operation can be started from a position spaced from the piece of fabric 8.

The sixth selector 46 is used to set the unitary amount Y of movement of the movable table 27 in the Y-axis direction to be effected subsequent to the second stitch during the bundling operation. The seventh selector 47 is used to set the number of stitches n to be effected during the button sewing operation in which the sew-through button 6 is sewed on the piece of fabric, and the eighth selector 48 is used to set the number of stitches N to be effected during the bundling operation.

Figure 15:
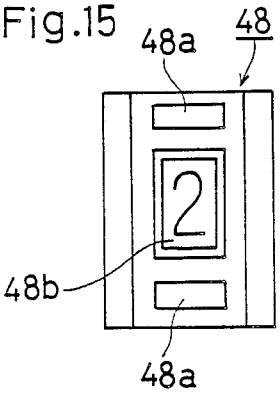
FIG. 15 is a front elevational view showing an example of a selector for setting the number of stitches to be formed during the bundling operation.

The eighth selector 48 includes, as shown in FIG. 15, a digital counter **48*b* of a type having a push-button 48*a*, said counter 48*b* being capable of successively displaying, one at a time, digits "0" to "9" each time the push-button 48*a*** is depressed. The digit "0" is indicative of the stitch number N being zero, that is, no bundling operation required; the digit "1" is indicative of the stitch number N being eight stitches to be performed to form the spinned cluster of thread; the digit "2" is indicative of the stitch number N being ten stitches to be performed to form the spinned cluster of thread; the digit "3" is indicative of the stitch number N being twelve stitches to be performed to form the spinned cluster of thread; the digit "4" is indicative of the stitch number N being fourteen stitches to be performed to form the spinned cluster of thread; . . . and the digit "9" is indicative of the stitch number N being twenty-four stitches to be performed to form the spinned cluster of thread.

The central processing unit 40C is provided with a calculating means for dividing the total number of stitches (16 stitches) into two equal parts (8 stitches×2) so that, by way of example, where the push-button **48*a* is operated to cause the counter 48*b* to display the digit "1", eight stitches can be performed during each of traverses of the stitching needle 1 in one direction from the piece of fabric 8 towards the sew-through button 6 and in the opposite direction from the sew-through button 6 towards the piece of fabric 8, allowing the resultant spinned cluster of thread to be formed by 16 turns of bundling thread 9 in total. Therefore, based on a result of calculation performed by the calculating means in the central processing unit 40C, the stepper motor 29 for moving the movable table 29 in the Y-axis direction can be automatically controlled to rotate reversibly in two directions opposite to each other thereby to move the movable table 27 relative to the stitching needle 1** in these directions opposite to each other to achieve the bundling operation.

The microcomputer unit 40 includes an up-down counter (not shown) for subtracting the number of stitches N preset by the seventh selector 47 so that, when the count performed by the up-down counter indicates zero, the central processing unit 40C can generate a sewing completion signal S indicative of the completion of the button sewing operation, which signal S is subsequently supplied through an input/output port 51 to a cylinder driver 52 thereby to cause the drive cylinder 15 to be driven to the retracted position. Reference numeral 50 represents a sensor for detecting the retraction of the drive cylinder 15, that is, the movement of the drive cylinder 15 from the extended position to the retracted position. This sensor 50 may be comprised of a reed switch and provides a detection signal S1 indicative of the retraction of the drive cylinder 15 to the microcomputer unit 40 through an interface circuit 53 so that the microcomputer unit 40 can subsequently generate a signal necessary to initiate the next succeeding bundling operation.

Reference numeral 54 represents a sensor for detecting the arrival of the stitching needle at a top dead point. This sensor 54 may be comprised of a reed switch and is adapted to generate, when the number of stitches n becomes zero, a detection signal S2 indicative of the position of the top dead point of the stitching needle 1, which signal S2 is applied to the microcomputer unit 40 through the interface circuit 53. Based on a logical calculation to determine the logical sum of the detection signal S2 from the sensor 54 and the detection signal S1 from the sensor 50, the microcomputer unit 40 generates an operating signal S3 which is applied through the input/output port 51 to a motor driver 56 to cause the two stepper motors 28 and 29 to be driven simultaneously thereby to move the movable table 27 in X-axis and Y-axis directions by an amount determined by the respective settings of the third to fifth selectors 43 to 45.

Figure 16:
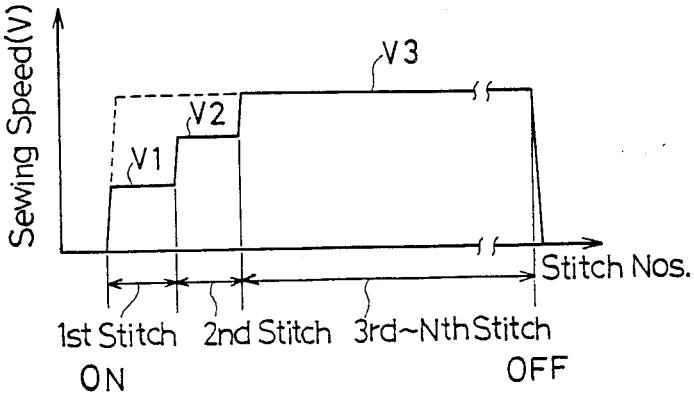
FIG. 16 is a chart showing a speed control program.

The program memory 40A built in the microcomputer unit 40 stores, as shown in FIG. 16, a selectable program for selecting one of a first mode, in which, during each of the button sewing and bundling operations, the sewing speed V1 for the first stitch, the sewing speed V2 for the second stitch and the sewing speed V3 for the normal stitching operation are so selected as to have a relationship of $V1<V2<V3$, and a second mode in which, during each of the button sewing and bundling operations, from the start to the end of stitching, a predetermined high sewing speed V3 is accomplished.

The operation of the control system of the above described construction will now be described with reference to the flowchart shown in FIG. 17 which is comprised of FIGS. **17*a* and 17*b***.

While the drive cylinder 15 extends, that is, is held in the extended position, the sew-through button 6 is elastically clamped by the button holder 14 and then held in the button sewing position as shown in FIG. 5 and the piece of fabric 8 after having been folded to provide the upper and lower segments is mounted on the fabric holder 19 with the upper and lower segments positioned above and below the fabric holder 19. Subsequently, the drive cylinder 20 is extended, that is, moved to the extended position by depressing a pedal (not shown), thereby to cause the fabric holder 19 to be brought into contact with the upper segment of the piece of fabric 8 against the fabric guide 12 to fix the piece of fabric 8 in position and, at the same time, by causing the drive cylinder 26 to move to the extended position, the fabric retainer 26 to be brought into contact with the upper segment of the piece of fabric 8 from above to avoid any possible formation of wrinkles on the piece of fabric 8.

With the piece of fabric 8 so set in position on the sewing machine, the sewing machine is operated. Consequent upon the operation of the sewing machine, the hole pitch P preset by the third selector 43 and the number of stitches n preset by the seventh selector 47 are read out from the data memory 40B at step 100. Then, at step 101, based on the data read out from the data memory 40B, the central processing unit 40C formulates a move data necessary to move the movable table 27 in the X-axis direction.

Thereafter, in accordance with the move data for the movable table 27 formulated by the central processing unit 40C at step 101, the movable table 27 is moved to the first stitch position for the button sewing at step 102, followed by the operation of the sewing machine. At this time, and at step 103, a decision is made to determine which one of the first and second modes of the selectable speed programs stored in the program memory 40A has been selected. If the first mode has been selected as determined at step 103, the button sewing operation is initiated at step 104 using the sewing speed of V1. However, if the second mode has been selected as determined at step 103, the button sewing operation is initiated at step 105 using the sewing speed of V3.

Then, at step 106, a decision is made to determine if a table move data formulated at step 101 has been completed. If the result of the decision at step 106 indicates that all of the table move data have been completed, the next succeeding decision is made at step 107 to determine if the machine has been halted. Should the machine be halted, a thread cutter (not shown) is operated to cut the thread and, at the same time the detection signal S2 from the sensor 54 is inputted to the microcomputer unit 40 through the interface circuit 53 so that, when the number of stitches n becomes zero, the central processing unit 40C supplies the sewing completion signal S through the input/output port 51 to the cylinder driver 52 to cause the drive cylinder 15 to assume the retracted position thereby to rotate the button holder 14 to the bundling position, as shown in FIG. 6, at step 108.

On the other hand, where the result of decision at step 106 indicates that the table move data formulated at step 101 has not yet been completed, a decision is made at step 109 to determine the presence or absence of the table move signal. In the event that the table move signal is present, and when the first mode of speed control program is selected, step 110 takes place to determine if the sewing speed is required to be changed as a result of the termination of the first stitching and also that of the second stitching, followed by step 111 at which the sewing speed is changed to the speed V2 or V3. Then, at step 112, the button sewing is carried out while the movable table 27 is reciprocatingly moved in the X-axis direction over an incremental distance corresponding to the hole pitch P and, after a predetermined number of stitches n has been formed to accomplish the button sewing on the piece of fabric, the program proceeds to step 107.

After the above described button sewing operation has been completed, and at step !08, the rotation of the button holder 14, that is, the retraction of the drive cylinder 15, is detected by the sensor 50 at step 114, with the detection signal S1 consequently supplied to the microcomputer unit 40 through the interface circuit 53. In response to the detection signal S1, the microcomputer unit 40 reads out, at step 115 shown in FIG. 17*b*, the data inputted into the data memory 40B through the third to sixth selectors 43 to 46, that is, the unitary amount $P+\Delta x$ of movement of the movable table 27 in the X-axis direction, the amount $\Delta y$ of movement of the movable table 27 in the Y-axis direction from the position 0 of the first stitch at the start of the bundling operation to the position A of second stitch, the amount y of movement of the movable table in the Y-axis direction subsequent to the second stitch and the number N of stitches during the bundling operation. Based on the data read out from the data memory 40B, the central processing unit 40C formulates the table move data for the movement of the movable table 27 at step 116.

Then, in response to the operating signal S3 outputted from the microcomputer unit 40 to the motor driver 56 through the input/output port 55, the movable table 27 is driven at step 117 by the stepper motors 28 and 29 to the position 0 at which the first stitching is performed. Thereafter, the sewing machine is operated and, at this time, a decision is made at step 118 to determine which one of the first and second modes of the speed control program, stored in the program memory 40A, has been selected. If the result of the decision at step 118 indicates that the first mode has been selected, the bundling operation is initiated at the speed V1 at step 119, but if the result of the decision at step 118 indicates that the second mode has been selected, the bundling operation is initiated at the speed V3 at step 120.

At step 121, a decision is made to determine if the table move data formulated at step 116 has been completed. Should the result of the decision at step 121 indicate that the table move data has been completed, the sewing machine is halted at step 122, followed by the return of the movable table 27 at step 123 to the original position determined by the respective settings of the first and second selectors 41 and 42, thereby completing the bundling operation.

On the other hand, if the result of the decision at step 121 indicates that the table move data has not yet been completed, the next succeeding decision is made at step 124 to determine the presence or absence of the table move signal. In the event of the presence of the table move signal, and if the selected speed control program is the first mode, a decision is then made at step 125 to determine if the sewing speed is required to be changed as a result of the completion of the first stitching and that of the second stitching, followed by the change of the sewing speed to the speed V2 or V3 at step 126 and then followed by step 127 during which the bundling corresponding to one stitching is carried out while the movable table 27 is moved every predetermined amount in the X-axis and Y-axis directions perpendicular to each other. At the time of completion of the bundling corresponding to one stitching, step 128 takes place to change over to the subsequent table move data, returning to step 121 at which the bundling is carried out a predetermined number N of stitches.

Figure 18:
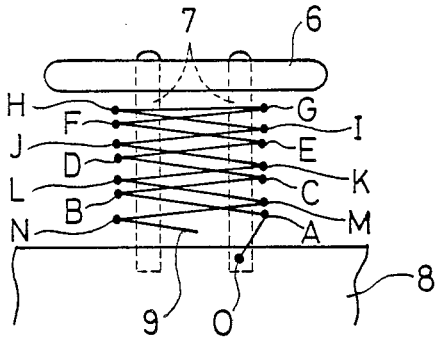
FIG. 18 is a view similar to FIG. 2, showing the manner in which a sew-through button is sewed on a piece of fabric with the use of the button sewing machine according to the present invention.
Figure 19:
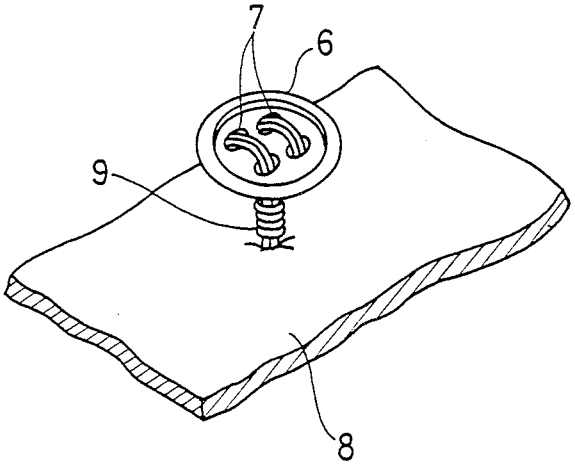
FIG. 19 is a schematic perspective view showing the sew-through button sewed on the piece of fabric according to the present invention.

By the series of the above described button sewing and bundling operations, the button sewing such as shown in FIG. 18, and the bundling at the stitching positions such as shown by A to N in FIG. 18, are continuously and efficiently performed to provide the sew-through button 6 which has been sewed firmly on the piece of fabric 8 in the generally floated fashion. It is to be noted that, in FIG. 13*b*, reference character 0 represents the position of the first stitching for the bundling, the resultant first stitch of the bundling thread 9 being sewed into the piece of fabric 8.

When the stopper adjusting member 36 is, prior to the bundling operation being effected, rotated to cause a free end of the fabric holder 19 to be moved either frontwards or rearwards depending on the thickness and/or the type of the piece of fabric 8, the position 0 for the first stitching to be effected during the bundling operation can be adjusted at a bent portion of the folded piece of fabric 8 in a direction conforming to the thickness of the piece of fabric 8 and, therefore, a sufficient resistance necessary to avoid any possible separation or displacement of the piece of fabric 8 can be imparted to the free end of the bundling thread 9 through the piece of fabric 8, thereby to avoid any possible upward escape of the free end of the bundling thread which would otherwise occur during upward movement of the sewing needle 1. In this way, with the free end of the bundling thread 9 firmly retained, the engagement of the looper with the bundling thread can be assuredly accomplished.

Also, by the provision of the speed changing means effective to switch the sewing speed V1, which is assumed at the start of each of the button sewing and bundling operations, over to a lower speed than the sewing speed V3 which is assumed during the normal button sewing or bundling operation, any possible disengagement of the sewing thread 7 or the bundling thread 9 in a direction downwards from the piece of fabric 8 under the influence of inertia force, which would be apt to occur when the piece of fabric 8 is slippery or coarse such as mesh, can be advantageously avoided, thereby ensuring that, regardless of the type of the piece of fabric on which the sew-through button is to be sewed, retention of the free end of the sewing or bundling thread 7 or 9 in the piece of fabric can be firmly accomplished. In addition, during each of the normal button sewing or bundling operation, the stitching speed is chosen to be high so that the button sewing can be highly efficient.

Figure 17A:
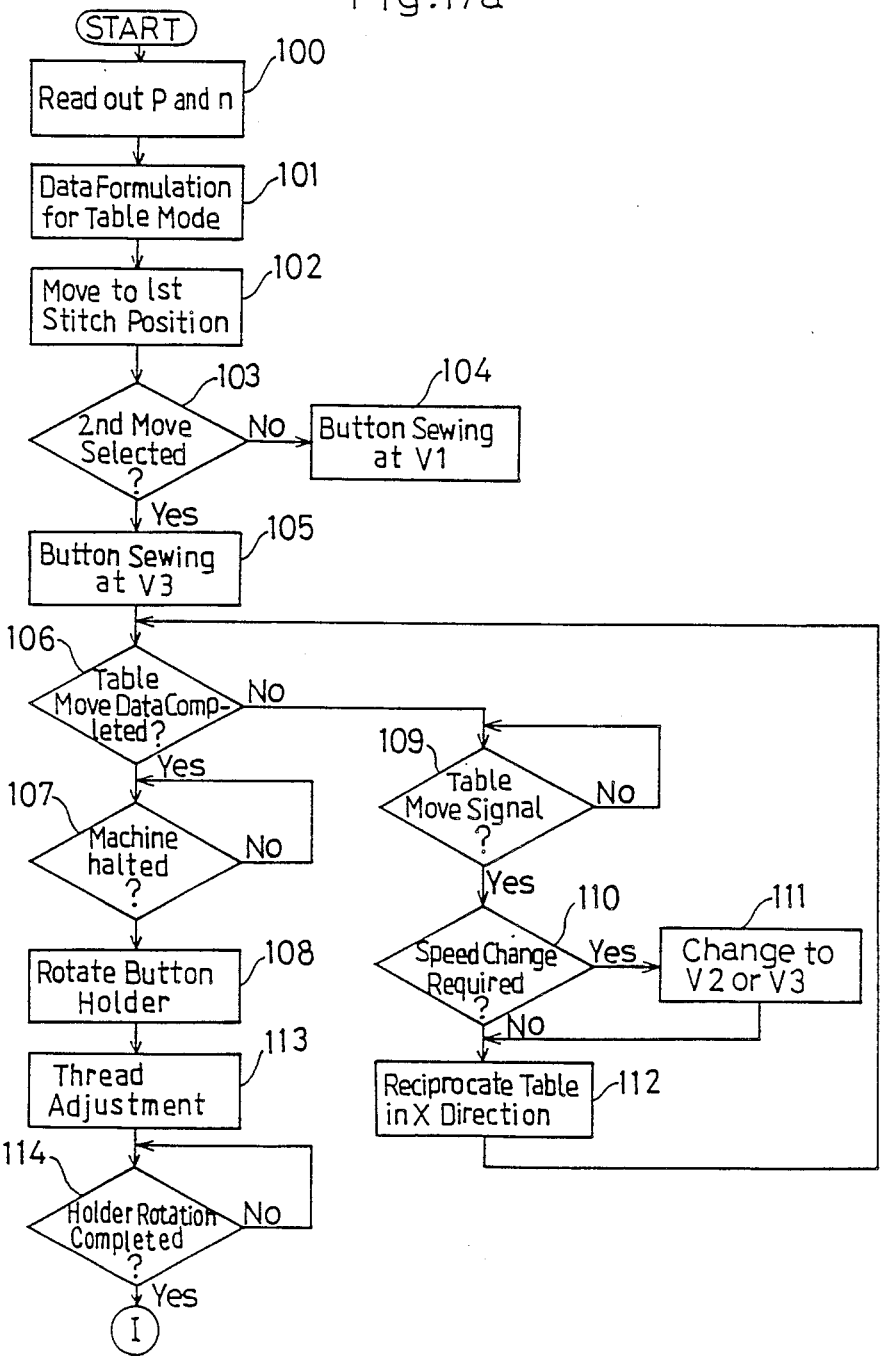
FIGS. 17*a* and 17*b* illustrate a flowchart showing the sequence of operation of the button sewing machine according to the present invention.

It is to be noted that the step 113 shown in FIG. 17*a* is a step during which a thread adjuster (not shown) used to adjust the tension of the thread is operated depending on the thickness and type of the thread used for the bundling to form the spinned cluster of thread referred to hereinbefore.

Figure 20A:
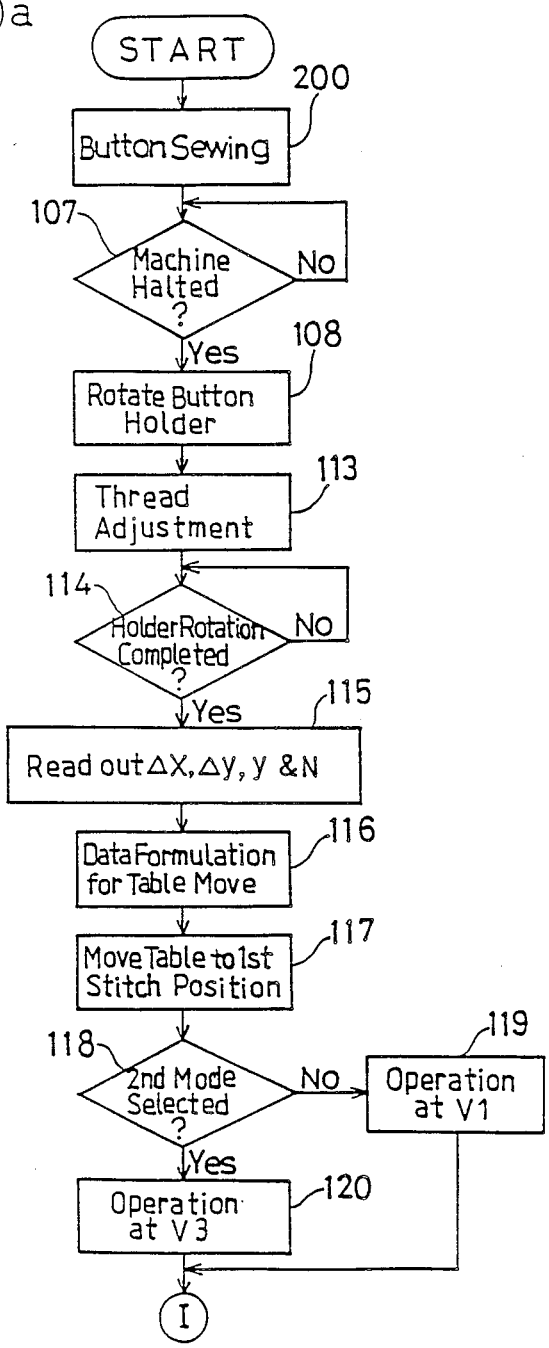
FIGS. 20*a* and 20*b* illustrate a flowchart showing the sequence of operation of the button sewing machine according to another preferred embodiment of the present invention.
Figure 20B:
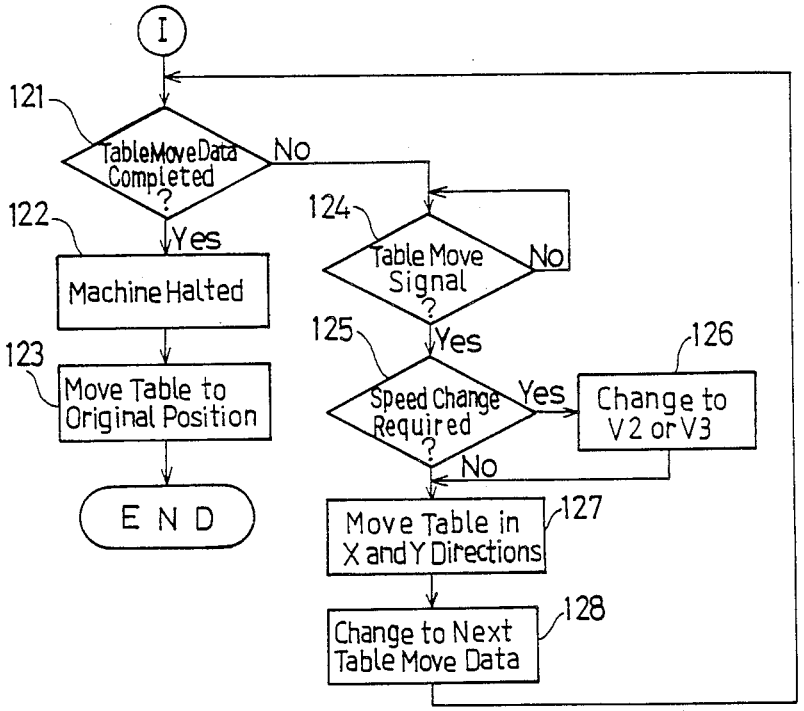

FIG. 20 comprised of FIGS. 20*a* and 20*b* illustrates a flowchart showing the alternative sequence of bundling operation to take place subsequent to the button sewing operation.

Figure 17B:
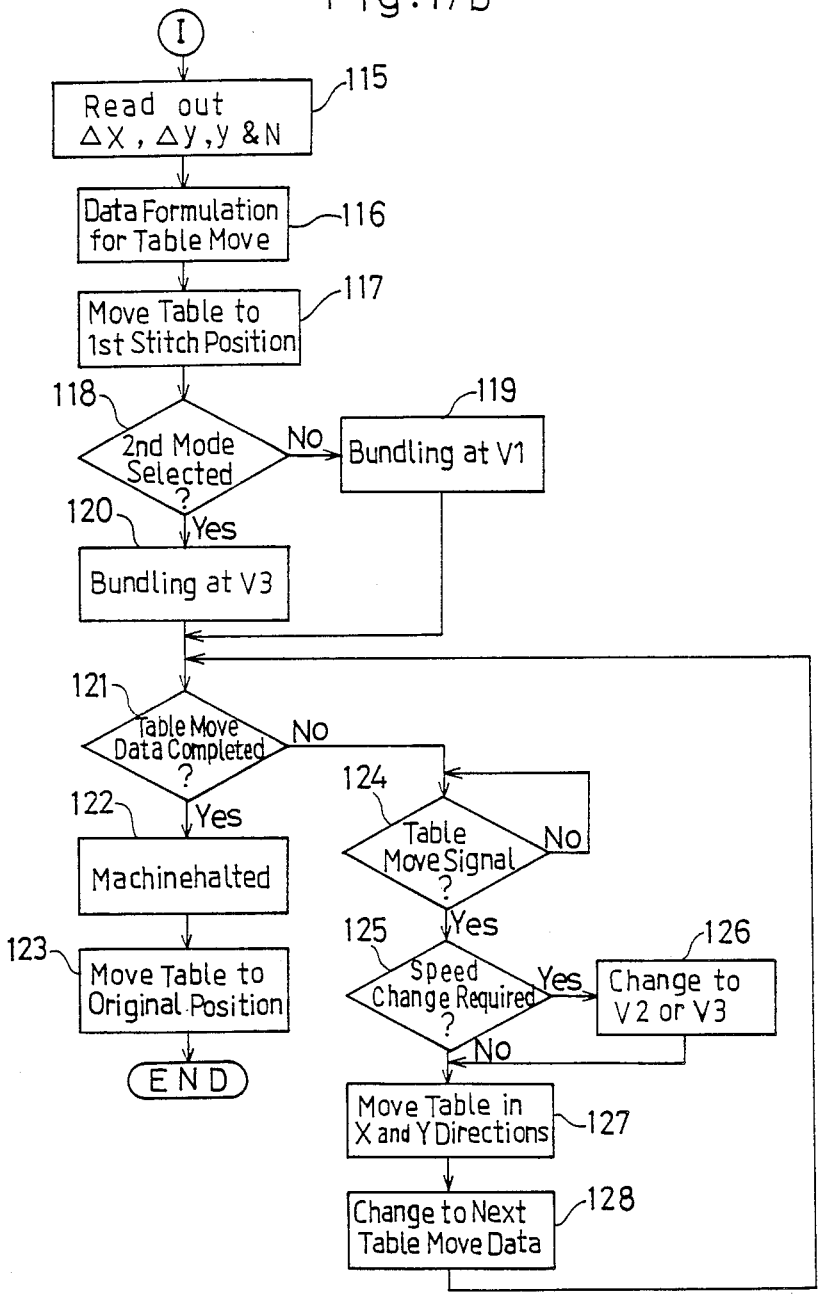

Referring now to FIGS. 20*a* and 20*b*, those steps similar to the steps shown in FIGS. 17*a* and 17*b* are referenced by like reference numerals. Step 200 during which the button sewing operation is performed is identical with the sequence from steps 100 to 105 shown in FIGS. 17*a* and 17*b* and, therefore, the details thereof will not be reiterated for the sake of brevity.

With the foregoing operation, the bundling operation is performed at respective stitching positions shown by A to N in FIG. 18, thereby to provide the sew-through button 6 firmly sewed on the piece of fabric 8 in the generally floated fashion. The position A at which the stitching for the bundling operation is initiated is changed, depending on the thickness of the piece of fabric 8 and the length of the looped thread formed by the sewing thread 9. By rotating the dial knob 45*a* of the fifth selector 45 so that any possible inconvenience, in which the bundling thread 9 may be unnecessarily cut or wrinkles are formed on the piece of fabric 8 as a result of the second stitch sewed into the piece of fabric 8 and/or the bundling thread 9 being unnecessarily be tensioned consequent upon the bundling at a position very close to the piece of fabric 8, can advantageously avoided to provide the sew-through button firmly sewed on the piece of fabric in the generally floated fashion.

Also, if the counter 48*b* in the fifth selector 48 is manipulated to change the total number of stitches for the bundling according to the length, diameter and/or the bundling thread 9, the possibility can be avoided in which the diameter of the spinned cluster of thread formed by spinning the bundling thread 9 may unnecessarily be increased to such an extent as to result in difficulty for the button on the piece of fabric to be engaged in the button hole defined in the opposite piece of fabric and/or which the firmness of fastening of the button on the piece of fabric may be lowered as a result of shortage of the number of turns of the bundling thread forming the spinned cluster of thread around the looped threads. Moreover, since the total number of stitches is divided into two equal parts so that in a direction lengthwise of the looped threads equal numbers of turns of the bundling thread can be formed in reciprocated fashion and, therefore, the resultant spinned cluster of thread can be uniformly shaped thereby to provide the sew-through button sewed firmly o the piece of fabric in the generally floated fashion.

Even through only the bundling operation is performed, the use of the speed changing means is effective to change the sewing speed V1, which is assumed at the start of the bundling operation, to a lower speed than the sewing speed V3 which is assumed during the normal bundling operation and, therefore, any possible disengagement of the sewing thread 7 or the bundling thread 9 in a direction downwards from the piece of fabric 8 under the influence of inertia force, which would be apt to occur when the piece of fabric 8 is slippery or coarse such as mesh, can be advantageously avoided, thereby ensuring that, regardless of the type of the piece of fabric on which the sew-through button is to be sewed, retention of the free end of the sewing or bundling thread 7 or 9 in the piece of fabric can be firmly accomplished. In addition, during each of the normal button sewing or bundling operation, the stitching speed is chosen to be high so that the button sewing can be achieved highly efficiently achieved.

In addition, where the width l over which the bundling operation is effected is relatively large, the reciprocating motion of the sewing needle 1 in a direction up and down and the synchronized reciprocating motion of the movable table 27 make it possible to perform the bundling operation at such stitching positions as shown by A to N in FIG. 18. On the other hand, where the width l over which the bundling operation is effected is relatively small, the amount of movement of the movable table 27 in the Y-axis direction is set to be zero. Therefore, the bundling thread 9 can be stitched with a predetermined number of stitches at a predetermined position. At this time, a lateral portion of the through-hole 13*a* in the protruding land over which the looped threads 7 extend is formed with the cutout 13*c* (See FIGS. 9 and 11) so that the bundling thread 9 being turned around the looped threads 7 can be freely displaceable. Therefore, the bundling thread 9 turned around the looped threads 7 can be urged to escape in a direction shown by the arrow z by the bundling thread 9 subsequently turned around the looped threads 7 as a result of the bundling thread 9 being moved to the same position by means of the sewing needle 1.

Thus, the bundling thread successively turned around the looped threads 7 at the predetermined position permits the earlier wound bundling thread 9 to be successively urged to escape in the direction shown by the arrow z and, therefore, even in the case where the bundling width l is so small as to result in the supply of the bundling thread 9 to the predetermined position in the y-axis direction, no localized bulge is formed in the resultant spinned cluster of bundling thread with the latter distributed uniformly in substantially equal thickness over the looped threads within a space between the piece of fabric 8 and the sew-through button 6 while the latter is firmly sewed on the piece of fabric in the generally floated fashion.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. For example, in the foregoing full description of the present invention, the sewing machine has been shown and described having dual functions of button sewing and bundling operations. However, in the practice of the present invention, the sewing machine may be so designed as to perform only the bundling operation.

Accordingly, such changes and modifications are, unless they depart from the spirit and scope of the present invention as delivered from the claims annexed hereto, to be construed as included therein.

What is claimed is:

1. A button sewing machine which comprises:
a stitching needle supported for reciprocating movement up and down;
a needle plate having defined therein an opening through which said stitching needle moves during the reciprocating movement thereof;
button holder means for holding a sew-through button to be sewed on a piece of fabric;
fabric holding means for supporting the piece of fabric while the piece of fabric is folded to provide upper and lower segments of fabric which are positioned above and below the fabric holding means, respectively;
fabric retainer means for pressing the upper segment of fabric from above to urge it against said fabric holding means;
drive means for driving said button holder means and said fabric holding means reciprocatingly and cyclically in a horizontal plane in first and second directions perpendicular to each other;
button holder position switching means for selectively said button holder means to assume one of a button sewing position, in which the sew-through button can be sewed on the piece of fabric by means of a looped thread extending between the sew-through button and the piece of fabric, and a bundling position in which the looped thread fastening the sew-through button to the piece of fabric can extend generally horizontal while traversing over the opening defined in said needle plate;
operating status changing means for selectively switching said drive means to assume one of a first status, in which said button holder means and said fabric holding means can be reciprocatingly driven in one of the directions perpendicular to each other, and a second status in which said button holder means and said fabric holding means can be simultaneously driven reciprocatingly in the directions perpendicular to each other; and
control means for detecting a completion of a button sewing job and operable in response to detection of the completion of the button sewing job to cause said button holder position switching means to assume the bundling position and also to cause said drive means to assume the second status.

2. The sewing machine as claimed in claim 1, further comprising:
speed changing means operable during any one of corresponding button sewing operation and bundling operation to change a stitching speed, assumed at an onset of a stitching operation, to a value lower than a stitching speed assumed during a normal stitching operation.

3. A button sewing machine which comprises:
a stitching needle supported for reciprocating movement up and down;
a needle plate having defined therein an opening through which said stitching needle moves during the reciprocating movement thereof;
button holder means for holding a sew-through button, which has been sewed on a piece of fabric by means of at least one looped thread connecting the sew-through button with the piece of fabric, so as to permit the looped thread to extend generally horizontally while traversing above the opening in said needle plate when the piece of fabric is folded to provide upper and lower segments thereof, one above the other;
fabric holding means adapted to be inserted in between the upper and lower segments of the piece of fabric to support the piece of fabric with the upper and lower segments positioned above and below said fabric holding means, respectively;
fabric retainer means for pressing the upper segment of fabric from above to urge it against said fabric holding means;
drive means for driving said button holder means and said fabric holding means reciprocatingly and cyclically in a horizontal plane in first and second directions perpendicular to each other;
means for changing and setting the position at which a bundling operation, for turning a bundling thread around the looped thread to form a spinned cluster of thread is initiated relative to the looped thread, in a direction generally parallel to the looped thread; and
control means for controlling said drive means so as to move said button holder and said fabric holding means to predetermined positions thereof.

4. The sewing machine as claimed in claim 3, further comprising:
stitch number setting means for setting the total number of stitches to be formed during the bundling operation; and
stitching number calculating means for dividing the total number of stitches, set by said stitch numbers and for outputting a control signal to said drive means so that the first number of stitches are formed on the looped thread in one of the opposite to each other along the length of the looped thread while the second number of stitches are formed on the same looped thread in the other of the directions opposite to each other.

5. The sewing machine as claimed in claim 3, an upper portion of said needle plate above the opening defined therein has a width greater than that of a lower portion of said needle plate below the opening in a direction generally parallel to the looped thread.

6. A button sewing machine which comprises:
a stitching needle supported for reciprocating movement up and down;
a needle plate having defined therein an opening through which said stitching needle moves during the reciprocating movement thereof;
button holder means for holding a sew-through button, which has been sewed on a piece of fabric by means of at least one looped thread connecting the sew-through button with the piece of fabric, so as to permit the looped thread to extend generally horizontally while traversing above the opening in said needle plate when the piece of fabric is folded to provide upper and lower segments thereof, one above the other;

fabric holding means adapted to be inserted in between the upper and lower segments of the piece of fabric to support the piece of fabric with the upper and lower segments positioned above and below said fabric holding means, respectively;

fabric retainer means for pressing the upper segment of fabric from above to urge it against said fabric holding means;

drive means for driving said button holder means and said fabric holding means reciprocatingly and cyclically in a horizontal plane in first and second directions perpendicular to each other; and first stitch position adjusting means for adjusting the position at which a first stitch is to be formed during a bundling operation, the bundling operation for turning a bundling thread around the looped thread to form a spinned cluster of thread, by moving the position of a free end of said fabric holding means in a direction close to and away from a plane in which said stitching needle is reciprocated.

7. The sewing machine as claimed in claim 6, further comprising:

speed changing means operable during any one of a corresponding button sewing and bundling operation and said bundling operation to change a stitching speed assumed at an onset of said bundling operation to a value lower than a stitching speed assumed during normal bundling operation.

8. The sewing machine as claimed in claim 6, an upper portion of said needle plate above the opening defined therein has a width greater than that of a lower portion of said needle plate below the opening in a direction generally parallel to the looped thread.

* * * * *